US005325551A

United States Patent [19]

Tappel et al.

[11] Patent Number: 5,325,551

[45] Date of Patent: Jul. 5, 1994

[54] MATTRESS FOR RETARDING DEVELOPMENT OF DECUBITUS ULCERS

[75] Inventors: James G. Tappel, Prairieville Township, Barry County; Christopher J. Hopper, Oshtemo Township, Kalamazoo County; Stephen C. Travis, Paw Paw Township, VanBuren County, all of Mich.

[73] Assignee: Stryker Corporation, Kalamazoo, Mich.

[21] Appl. No.: 900,067

[22] Filed: Jun. 16, 1992

[51] Int. Cl.[5] ..... A61G 7/04

[52] U.S. Cl. ..... 5/453; 5/450; 5/469; 5/481

[58] Field of Search ..... 5/449, 450, 453, 468, 5/469, 481

[56] References Cited

U.S. PATENT DOCUMENTS

| | | | |
|---|---|---|---|
| 2,750,606 | 6/1956 | Freedlander et al. . | |
| 2,826,244 | 3/1958 | Hurley | 5/469 |
| 3,644,950 | 2/1972 | Lindsay, Jr. | 5/469 X |
| 3,798,686 | 3/1974 | Gaiser . | |
| 4,189,798 | 2/1980 | Vessey | 5/481 X |
| 4,394,784 | 7/1983 | Swenson et al. | 5/453 |
| 4,542,547 | 9/1985 | Sato . | |
| 4,686,722 | 8/1987 | Swart | 5/453 |
| 4,694,520 | 9/1987 | Paul et al. | 5/453 |
| 4,803,744 | 2/1989 | Peck et al. . | |
| 4,873,737 | 10/1989 | Savenije | 5/453 |
| 4,949,412 | 8/1990 | Goode | 5/453 |
| 4,977,633 | 12/1990 | Chaffee | 5/453 |
| 4,995,124 | 2/1991 | Wridge, Jr. et al. | 5/450 |
| 5,020,176 | 6/1991 | Dotson | 5/453 |
| 5,068,933 | 12/1991 | Sexton | 5/453 |

FOREIGN PATENT DOCUMENTS

| | | |
|---|---|---|
| 0387045 | 9/1990 | European Pat. Off. . |
| 0475593 | 3/1992 | European Pat. Off. . |
| WO92/07541 | 5/1992 | PCT Int'l Appl. . |
| 2212058 | 7/1989 | United Kingdom . |

*Primary Examiner*—Michael F. Trettel

*Attorney, Agent, or Firm*—Flynn, Thiel, Boutell & Tanis

[57] ABSTRACT

A mattress unit for retarding the development of decubitus ulcers includes a fabric cover having therein a foam material, and includes an inflatable bladder and a control unit disposed within openings in the foam material. The inflatable bladder contains a foam material having spaced holes in it. The control unit includes a pump which can selectively supply pressurized air to the bladder, a valve which can selectively bleed air from the bladder, and a pressure sensor which can determine the current pressure in the bladder. The pressure sensor is coupled to an input of a control circuit which controls the pump and valve. The control circuit receives power from an AC/DC converter and is remotely controlled by a hand-held pendant, the converter and pendant each being physically separate from the mattress unit and being connected to the control circuit by respective cables.

37 Claims, 5 Drawing Sheets

AIR BLADDER
41
43
42
47
46
51
54
53
148
152
157
154, 156
151
141
VALVE
CHECK VALVE
PUMP
131
RELIEF VALVE
134
146
158
159
182
HOUSING
121, 122
147
176
178
179
181
VENT
POWER
POWER
FAST
SLOW
WATCHDOG TIMER
SYSTEM RESET
136
CIRCUIT BOARDS
CONTROL CIRCUIT
172
μP
174
ROM
RAM
173
POWER
PRESURE SENSOR
128
POWER
ANALOG TO DIGITAL
183
184
171
127
126
PENDANT CONTROL
18
19
24 V DC
17
AC TO DC CONVERTER
16
110/220V AC
191
AUTO LED
192
MANUAL LED
193
AIR LOSS LED
187
AUTO SWITCH
188
FIRM SWITCH
189
SOFT SWITCH

MATTRESS FOR RETARDING DEVELOPMENT OF DECUBITUS ULCERS

FIELD OF THE INVENTION

The present invention relates to a mattress and, more specifically, to a mattress designed to retard the development of decubitus ulcers.

BACKGROUND OF THE INVENTION

In situations where an invalid or medical patient must spend a relatively long period of time confined to a bed, a frequent problem is the eventual development of decubitus ulcers, commonly known as bedsores. A variety of mattresses have been developed over the years to treat decubitus ulcers once they have developed. However, more recently, attention has been turned to the design of mattresses which can be adopted for use prior to the development of decubitus ulcers and which are relatively effective in retarding the development of decubitus ulcers. However, although preexisting mattresses of this type have been generally adequate for their intended purposes, they have not been satisfactory in all respects. One common problem is that they are large and structurally complex, to the point where they are typically constructed as an integral part of an entire bed.

An object of the present invention is to provide an improved mattress which is effective in retarding the development of decubitus ulcers, and which is structurally simple in comparison to existing units and utilizes relatively inexpensive components.

It is a further object of the invention to provide such a mattress which is effectively self-contained and is comparable in size, shape and weight to a conventional hospital mattress, and which can thus be quickly and easily substituted for a conventional mattress on a conventional hospital bed without incurring the cost and inconvenience of replacing the entire bed.

It is a further object to provide such a mattress which will operate reliably over a relatively long lifetime with little or no maintenance.

It is a further object to provide such a mattress which is highly modular and can be quickly and easily disassembled and reassembled, so that maintenance can be carried out in a short period of time and will involve replacement only of components which are in fact defective, thereby minimizing the expense of maintenance.

It is a further object to provide such a mattress which has therein an inflatable bladder, a control unit which controls the air pressure within the bladder being physically embedded within the mattress itself.

SUMMARY OF THE INVENTION

The objects and purposes of the invention, including those set forth above, are met according to one form of the invention by providing an apparatus which includes a mattress unit having therein an inflatable bladder, and a selectively actuable arrangement which can selectively supply pressurized gas to and remove gas from the inflatable bladder and which is physically located within the mattress unit.

A different form of the present invention involves the provision of a mattress unit, an inflatable bladder disposed within the mattress unit, a manually actuable arrangement for selectively varying a first pressure set point and for selecting one of first and second operational modes, and a control arrangement for controlling a gas pressure in the bladder, the control arrangement being responsive to selection of the second operational mode for automatically selectively supplying pressurized gas to and removing pressurized gas from the inflatable bladder so as to maintain the gas pressure in the bladder substantially at a second pressure set point, the control arrangement being responsive to selection of the first operational mode for automatically selectively supplying pressurized gas to and removing pressurized gas from the inflatable bladder so as to maintain the gas pressure in the bladder substantially at the first pressure set point.

According to a different form of the invention, an apparatus includes a mattress unit, an inflatable bladder disposed within the mattress unit, and a control arrangement for controlling the gas pressure within the inflatable bladder, the control arrangement including a selectively actuable supply arrangement for supplying pressurized gas to the bladder at a selected one of first and second rates which are different.

Still another form of the invention involves the provision of an apparatus which includes a mattress unit, an inflatable bladder disposed within the mattress unit, a control arrangement for selectively supplying pressurized gas to and removing gas from the inflatable bladder so as to maintain the gas pressure in the bladder at a specified pressure, and a hand-held control unit separate from and external to the mattress unit and coupled by a cable to the control arrangement for effecting manual variation of the selected pressure.

Yet another form of the present invention involves the provision of a mattress unit having therein an inflatable bladder, and having therein a foam material which extends around the entire periphery of the inflatable bladder and which covers the entire top of the inflatable bladder.

Another form of the present invention involves the provision of a mattress unit, an inflatable bladder disposed within the mattress unit, and a selectively actuable control arrangement disposed within the mattress for selectively supplying pressurized gas to and removing gas from the bladder, wherein the inflatable bladder includes a gas impermeable cover having therein a foam material, the foam material in the bladder having a plurality of openings provided therein at spaced locations.

BRIEF DESCRIPTION OF THE DRAWINGS

A preferred embodiment of the present invention is described in detail hereinafter with reference to the accompanying drawings, in which.

DETAILED DESCRIPTION

Figure 1:
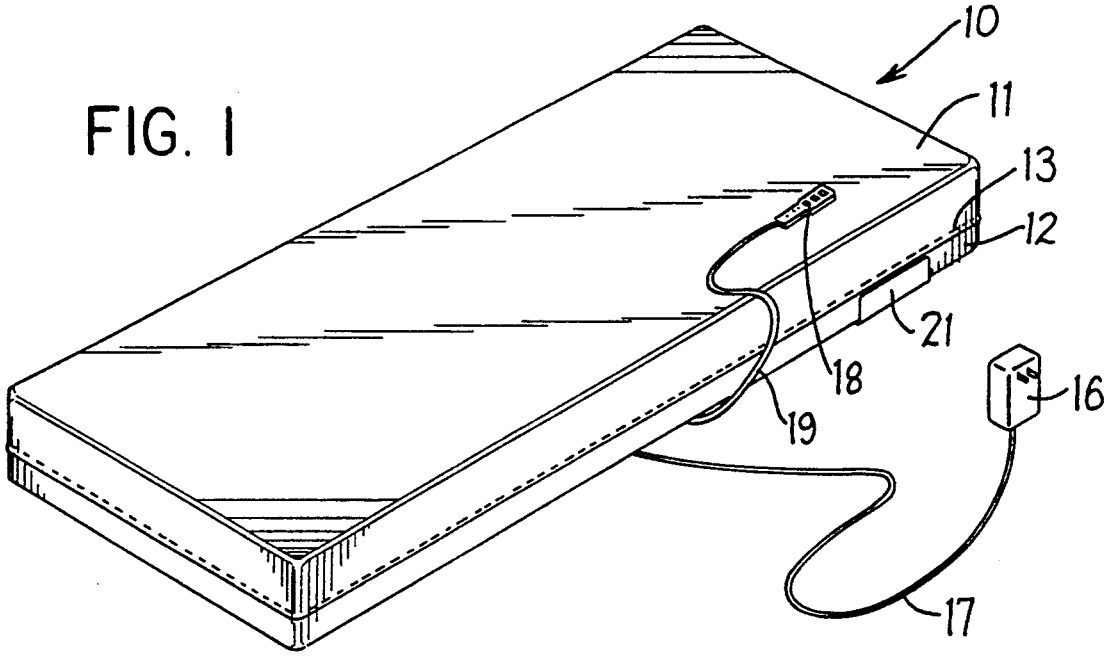
FIG. 1 is a perspective view of a mattress unit which embodies the present invention.

FIG. 1 depicts a mattress unit 10 which embodies the present invention. The mattress unit 10 has an approximately rectangular shape, and in particular corresponds in overall size and shape to conventional and commercially available "twin-size" mattresses, so that the mattress unit 10 can be quickly and easily installed on an existing bed in place of a conventional mattress.

The mattress unit 10 includes upper and lower cover portions 11 and 12 made of a fabric material which, in the preferred embodiment, is polyurethane-coated nylon. Alternatively, it could be vinyl. The upper and lower cover portions 11 and 12 are releasably secured to each other by a conventional zipper which is shown diagrammatically by the broken line 13 and which extends around the periphery of each cover portion.

An AC to DC converter 16 is provided and can be plugged into a conventional 110 volt AC or 220 volt AC wall outlet. The circuitry within the converter 16 is conventional, and therefore not shown in detail. The converter 16 converts the AC power from the wall outlet into 24 VDC power, which is supplied through a cable 17 to a control unit disposed within the mattress 10. The control unit is not visible in FIG. 1, but is disclosed in detail later.

A hand-held pendant 18 is also provided, and is coupled by a cable 19 to the control unit in the mattress. The cables 17 and 19 enter the bottom of the mattress through a common opening provided approximately in the center of the lower cover portion 12. The pendant 18 has three push buttons and three light emitting diodes (LEDs), which are described in detail later. The pendant 18 is sealed against moisture. The lower cover portion 12 has an extra piece of material 21 sewn to it on one side in order to create a pocket, into which the hand-held pendant 18 can be inserted when not in use. It is also possible to provide a not-illustrated clip on the cable 19 at a location approximately halfway between the pendant 18 and the mattress, permitting the cable 19 to be clipped to the mattress cover or to bedclothing on the mattress so that, if a patient accidently drops the pendant 18, a portion of the cable 19 will be within close reach and the patient will be able to retrieve the pendant 18 by pulling on the cable 19.

Figure 2:
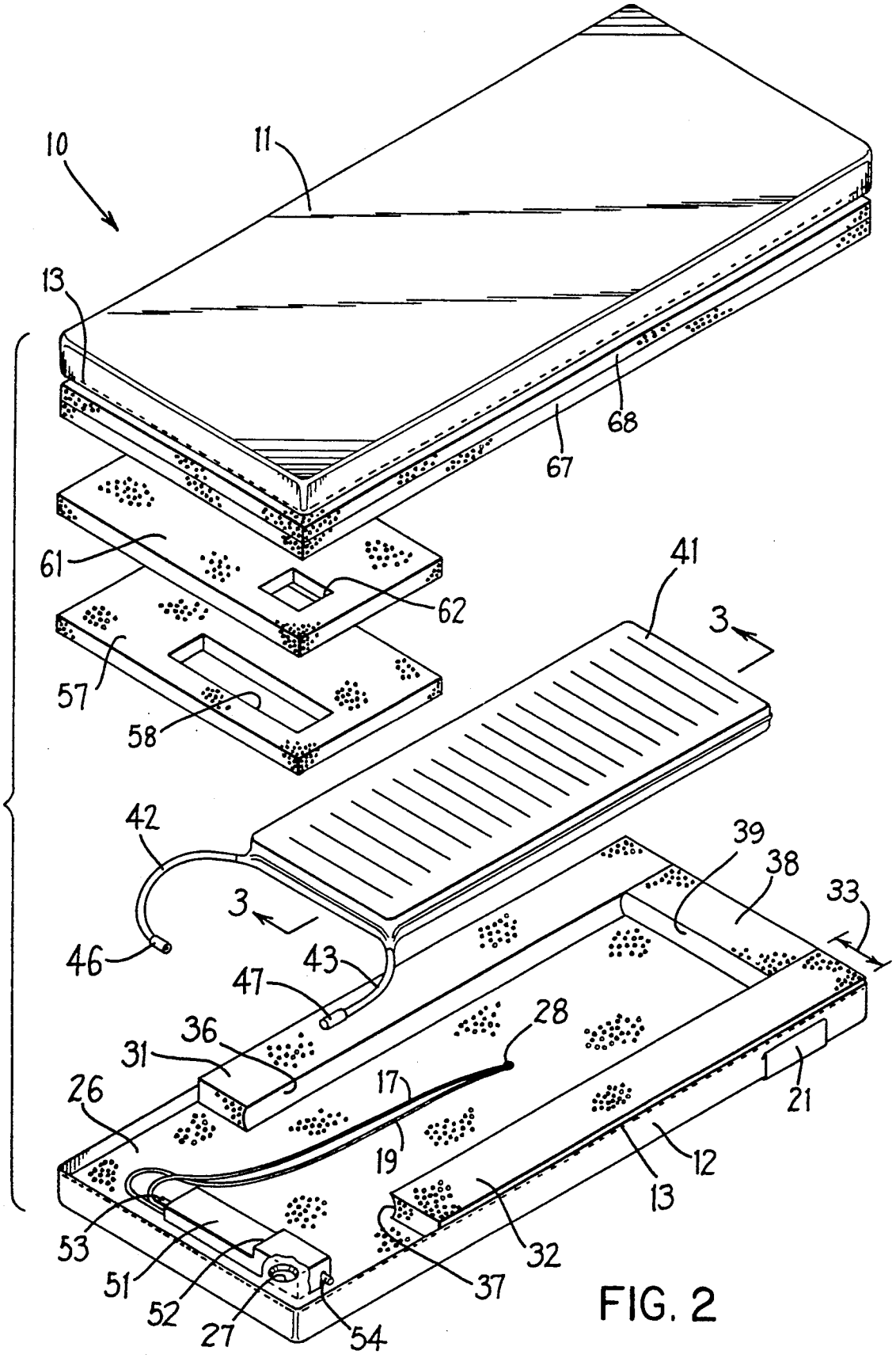
FIG. 2 is an exploded perspective view of the mattress unit of FIG. 1.

FIG. 2 is an exploded view of the mattress unit 10 of FIG. 1. A rectangular foam bottom sheet 26 is provided in the bottom of and extends the full width and length of the lower cover portion 12. The bottom sheet 26 has near one corner at the foot end of the mattress a shallow circular recess 27 provided for a purpose explained later. Also, a circular center hole 28 is provided through the center of the bottom sheet 26, and the power and pendant cables 17 and 19 extend through the hole 28. In the preferred embodiment, the bottom sheet 26 has an indention load deflection (ILD) value which is in the range of 25–45 lbs. All foam components of the mattress unit 10, including the bottom sheet 26, are open cell foam, although it will be recognized that closed cell foam could be used for certain foam components such as bottom sheet 26.

Resting on top of the opposite side edges of the bottom sheet 26 are two elongate side elements 31 and 32 which each extend from the head end of the mattress approximately three-quarters of the way toward the foot end. The side elements 31 and 32 have an approximately rectangular cross-section, the larger dimension of which is the width dimension 33. The inwardly facing surfaces 36 and 37 of the side elements 31 and 32 are concave. In the preferred embodiment, the width dimension 33 is approximately six inches, and the side elements 31 and 32 each have an ILD value in the range of 25–35 lbs.

A head end foam element 38 rests on the edge portion of the bottom sheet 26 at the head end of the mattress, and has a cross-section and an ILD range which are identical to those for side elements 31 and 32. The inwardly facing surface 39 of the head element 38 is concave, and the ends of the head element 38 are each rounded to mattingly engage the concave surfaces 36 and 37 on the side elements 31 and 32.

An inflatable air bladder 41 of generally rectangular shape rests on the bottom sheet 26 between the side elements 31 and 32 so that three sides of the air bladder 41 engage the respectively concave surfaces 36, 37 and 39. The vertical thickness of the air bladder 41 is substantially equal to the vertical thicknesses of side elements 31 and 32 and head element 38. The end of the air bladder 41 remote from element 38 is approximately flushly aligned with the adjacent end surfaces of the side elements 31 and 32. The internal construction of the air bladder 41 is described in more detail later. Two air hoses 42 and 43 each communicate with the interior of the air bladder 41 at opposite corners of the end nearest the foot end of the mattress. The air hoses 42 and 43 have at the outer ends thereof respective conventional connector elements 46 and 47.

A plastic housing 51 contains the control unit for the mattress, and has an overall shape in a top view which is approximately rectangular. Adjacent one end, the housing 51 has a circular downward projection which is not visible in FIG. 2 but which extends into the circular recess 27 provided in the bottom sheet 26, and has at the same end an upward projection 52 of rectangular shape. Projecting outwardly from opposite ends of the housing 51 are respective connectors 53 and 54, which can be respectively releasably coupled to the connectors 46 and 47 on the air hoses 42 and 43. In the preferred embodiment, the connectors 46/53 and 43/54 are conventional and commercially available components available from CPC of St. Paul, Minn. as part number 230-06.

A lower foot end foam sheet 57 is of rectangular shape, and rests on the bottom sheet 26 above the cables 17 and 19 and the air hoses 42 and 43. The sheet 57 has a rectangular cutout 58 corresponding in size to the overall rectangular dimensions of the housing 51 for the control unit, the housing 51 being snugly received within the cutout 58. The sheet 57 extends between opposite sides of the mattress unit, and extends from the foot end of the mattress unit to the adjacent ends of the side elements 31 and 32. In the preferred embodiment, the sheet 57 has an ILD value which is in the range of 15–30 lbs.

An upper foot end foam sheet 61 is identical in overall size and shape to and is made of the same material as the lower foot end foam sheet 57, the sheets 57 and 61 having a combined vertical thickness which is substantially the same as the vertical thicknesses of air bladder 41 and side elements 31 and 32. The sheet 61 has through it a rectangular cutout 62 which corresponds in shape to and which receives the rectangular upward projection 52 on the control unit housing 51.

A first foam top sheet 67, which has the same length and width dimensions as the bottom sheet 26, is provided on top of the side elements 31 and 32, air bladder 41, head end element 38 and upper foot end sheet 61. In the preferred embodiment, it has an ILD value which is in the range of 15–25 lbs.

Provided on top of the first top sheet 67 is a second top sheet 68, which has the same length and width dimensions as the top sheet 67, and which preferably has an ILD value in the same range as the sheet 67. In the preferred embodiment, the top sheet 68 is a popular foam material available under the name OMALUX, which can be obtained commercially from E. R. Carpenter of Richmond, Va. However, it will be recognized that any equivalent conventional foam material which falls within the specified ILD range will be suitable for purposes of the present invention. In the preferred embodiment, the top sheets 67 and 68 have a combined vertical thickness of at least two inches.

The foam elements 31, 32, 38, 57 and 61 are somewhat stiffer than the pressurized bladder 41, and thus serve as a frame which helps to keep a patient centered on the bladder. Also, after giving a hypodermic injection, hospital personnel sometimes insert the needle temporarily into a mattress while completing other tasks. In the preferred embodiment, the six inch horizontal width of foam elements 31, 32 and 38 and the two inch vertical thickness of foam sheets 67 and 68 protect against puncture of the bladder in the event a hypodermic needle is inserted into the mattress unit 10.

In the mattress unit 10, the air bladder 41, the control unit housing 51 and the various illustrated foam components are not physically connected to each other, but instead are held in their relative positions simply by virtue of the fact that together they snugly fill the space available within the upper and lower cover portions 11 and 12. Thus, it will be recognized that the mattress unit 10 has been designed to have a high degree of modularity, permitting any worn or broken component to be quickly and easily replaced. Further, if a mattress of slightly different size were required for a particular application, it will be recognized that the air bladder 41 and the control unit in housing 51, as well as the AC/DC converter 16 and pendant control 18, could be used without modification, it being necessary only to make appropriate adjustments to the sizes of the cover portions and the various foam elements, which obviously involves changes only to the less complex components and thus requires minimal time, effort and expense.

The provision of the control unit in the foot portion of the mattress keeps noise generated by the control unit as far as possible from the head of a person on the mattress. Also, in the event it is necessary for a second person to get onto the mattress to perform cardiopulmonary resuscitation (CPR) on a patient, the second person will not be inconvenienced by lumps in the mattress under the torso of the patient.

Figure 4:
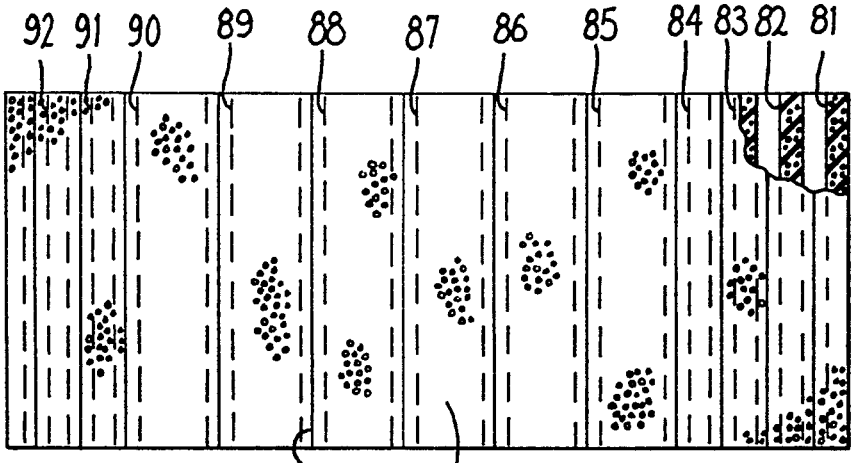
FIG. 4 is a top view of a foam core which is a component of the air bladder of FIG. 3.
Figure 3:
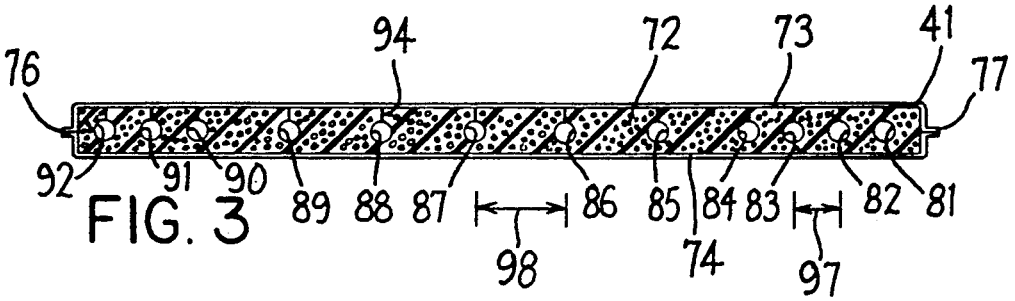
FIG. 3 is a sectional view of an air bladder which is a component of the mattress unit of FIG. 1, taken along the line 3—3 in FIG. 2.

The internal construction of the air bladder 41 is shown in more detail in FIGS. 3 and 4. The air bladder 41 is filled by a foam sheet 72 which is of generally rectangular shape. In the preferred embodiment, the foam sheet 72 has an ILD for the foam material itself which is less than 15 lbs. The foam sheet 72 has above it an upper sheet 73 and has below it a lower sheet 74. In the preferred embodiment, the sheets 73 and 74 are made of polyurethane-coated nylon. The sheets 73 and 74 are bonded in a conventional manner to the surfaces of the foam core 72, and along the peripheral edges of the foam core the sheets 73 and 74 are bonded to each other in a conventional manner, for example as shown at 76 and 77 in FIG. 3.

The foam core 72 has a plurality of horizontal cylindrical holes 81–92 extending transversely therethrough. The holes 81–92 soften the sheet 72, and also facilitate rapid air movement within the bladder so that pressure equilibrium is quickly restored after a change. It should be noted that the spacing 97 between adjacent holes is, for the four holes 81–84 at the head end of the bladder and the three holes 90–92 at the opposite end, approximately half the spacing 98 between adjacent holes 84–90 in the center region of the bladder. The holes 81–92 increase the softness of the air bladder, and in particular can be used to give the foam sheet 72 an effective ILD value which is less than the rated ILD value of the material of the foam sheet when no holes are present, and in fact the provision of holes 81–92 allows the foam sheet 72 to be given an effective ILD value which is less than the lowest ILD foam material readily available on the commercial market. By varying the spacing between adjacent holes in different portions of the foam sheet 72, as shown at 97 and 98 in FIGS. 3 and 4, respective portions of the foam sheet 72 can be given different effective ILD values. In the preferred embodiment, as shown in FIGS. 3 and 4, the holes 81–92 are all of uniform diameter and the spacing between adjacent holes is varied, but it will be recognized that an equivalent result can be achieved by varying the diameters of the holes while maintaining a uniform spacing between adjacent holes, or by varying both the diameters and the spacing. Also, of course, the effective ILD of the foam can be relatively uniformly reduced by using uniformly spaced holes of equal diameter. The result is that different portions of the bladder will exhibit different stiffness properties even though the same air pressure is present throughout the bladder.

Extending from each of the holes 81–92 to the upper surface of the foam sheet 72 is a lengthwise slit, one of which is designated by reference numeral 94. The slits 94 are a by-product of the particular process used to create the holes 81–92, and have no functional effect or significance in the resulting air bladder 41. The slits 94 thus could be omitted.

Figure 5:
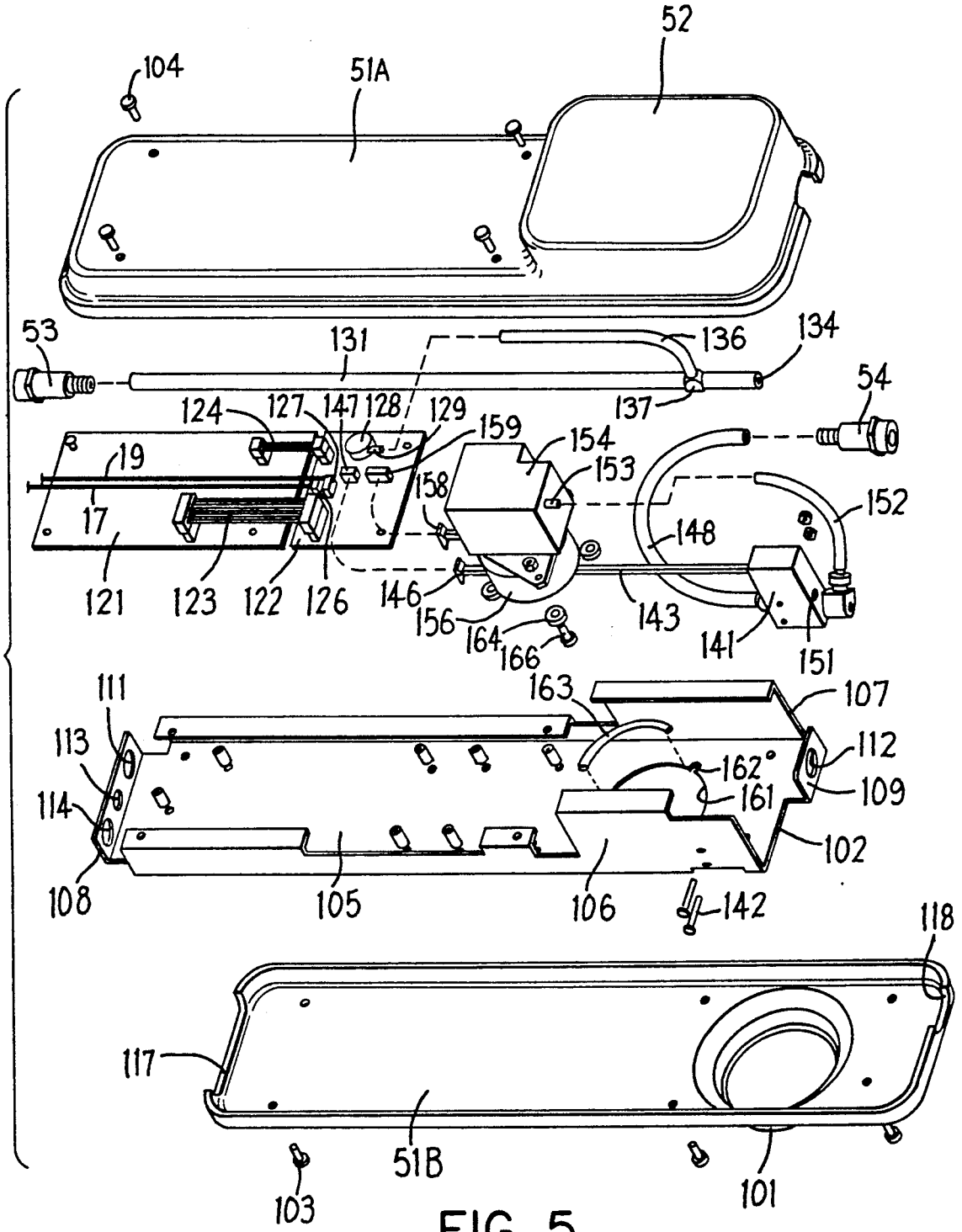
FIG. 5 is an exploded perspective view of a control which is a component of the mattress unit of FIG. 1.

The housing 51 for the control unit and the components of the control unit disposed within the housing are shown in the exploded view of FIG. 5. Referring to FIG. 5, the housing is made of plastic and includes two separate halves which are respectively designated with reference characters 51A and 51B. The upper housing part 51A includes the rectangular upward projection 52, and the lower housing part 50B has thereon the circular downward projection 101 which is received in the circular recess 27 (FIG. 2) of the foam sheet 26. A chassis 102 made from a sheet of bent metal is provided between the housing parts. The lower housing part 51B is secured to the chassis by screws 103, and the upper housing part 51A is secured to the chassis by screws 104.

The chassis 102 has a bottom wall 105, two side walls 106 and 107 extending upwardly from opposite edges of the bottom wall 105, and two end walls 108 and 109 extending upwardly from opposite ends of the bottom wall 105. The end wall 108 has an opening 111 therethrough in which the connector part 53 is fixedly mounted, and the end wall 109 has an opening 112 therethrough in which the connector part 54 is fixedly mounted. The end wall 108 also has two openings 113 and 114 through which the power and pendant cables 17 and 19 extend. The housing part 51B has recesses 117 and 118 at opposite ends thereof through which the connectors 53 and 54 project and through which the cables 17 and 19 extend, and the upper housing part 51A has similar recesses.

Two circuit boards 121 and 122 are bolted to the chassis 102, and are electrically connected to each other by two conventional ribbon cables 123 and 124. The circuit board 122 has a power connector 126 into which a connector at the end of the power cable 17 is removably plugged, and has a pendant connector 127 into which a connector at the end of the pendant cable 19 is removably plugged. The circuit board 122 also has mounted on it a pressure sensor 128, which is a conventional component commercially available from Motorola, Inc. of Austin, Tex. as part number MPX2010GP. The pressure sensor 128 has on it an inlet nipple 129.

An air conduit 131 has one end connected to the connector part 53, and tightly forcibly inserted into the other end thereof is a cylindrical pressure relief valve 134, which is a conventional component commercially available from Donald Engineering of Grand Rapids, Mich. as part number 110PPB#1.5. The relief valve 34 is a normally closed mechanical valve which does not open during normal system operation, but will open and vent air from the conduit 131 into the interior of housing 51 if the pressure in conduit 131 exceeds a predetermined maximum safety value. A sensor conduit 136 has one end in communication with the conduit 131 through a T-fitting 137, and its other end connected to the nipple 129 on sensor 128.

A control valve 141 is fixedly mounted to the side wall 106 of the chassis 102 by a pair of bolts 142. In the preferred embodiment, the pressure control valve 141 is a conventional component commercially available from Humphrey Products of Kalamazoo, Mich. as part number 310-24V. The control valve 141 has an electrical control cable 143 terminating in a connector part 106 which is removably plugged into a valve connector 147 on the circuit board 122. An air conduit 148 has one end coupled to the control valve 141 and its opposite end coupled to the connector part 54. The control valve 141 can selectively couple the air conduit 148 to either an exhaust opening 151 or a further conduit 152. The valve 141 is a normally closed valve which, in the absence of power, prevents the conduit 148 from communicating with the exhaust opening 151 and effects fluid communication between conduit 148 and conduit 152.

The end of conduit 152 remote from valve 141 is connected to an outlet nipple 153 on an air pump 154, which is driven by an electric motor 156. The pump 154 and motor 156 are commercially available as an integral unit from Gilian of West Caldwell, N.J. as part number E-801162. The pump has a check valve 157 which permits air flow out of the pump into conduit 152, but prevents air flow from conduit 152 back into the pump. The motor 156 receives power and control signals through a cable terminating in a connector part 158, which is removably plugged into a pump connector 159 provided on the circuit board 122. The bottom wall 105 of the chassis 102 has a circular opening 162 through it, and has three semi-circular recesses, one of which is visible at 162, provided along the periphery of the opening 161 at uniformly spaced locations. A single strip grommet 163 has a length slightly less than one-third of the circumference of the opening 161, and has a lengthwise slit which receives an edge portion of the chassis wall 105. Three washer-like rubber grommets 164 each have a central through opening and a circumferential groove, and each is inserted into a respective one of the recesses 162 so that the groove receives the edge of the chassis defining the recess 162. The cylindrical electric motor 156 projects through the opening 161, and bolts 166 extend through the grommets 164 and through openings in a flange on the motor 156, in order to secure the motor 156 and pump 154 to the chassis 102. The grommets 164 absorb vibrations generated by the motor 156 and pump 154, and the strip grommet 163 prevents the control cable for the motor 156 from rubbing directly against the metal edge of the opening 161 and the chassis 102.

Figure 6:
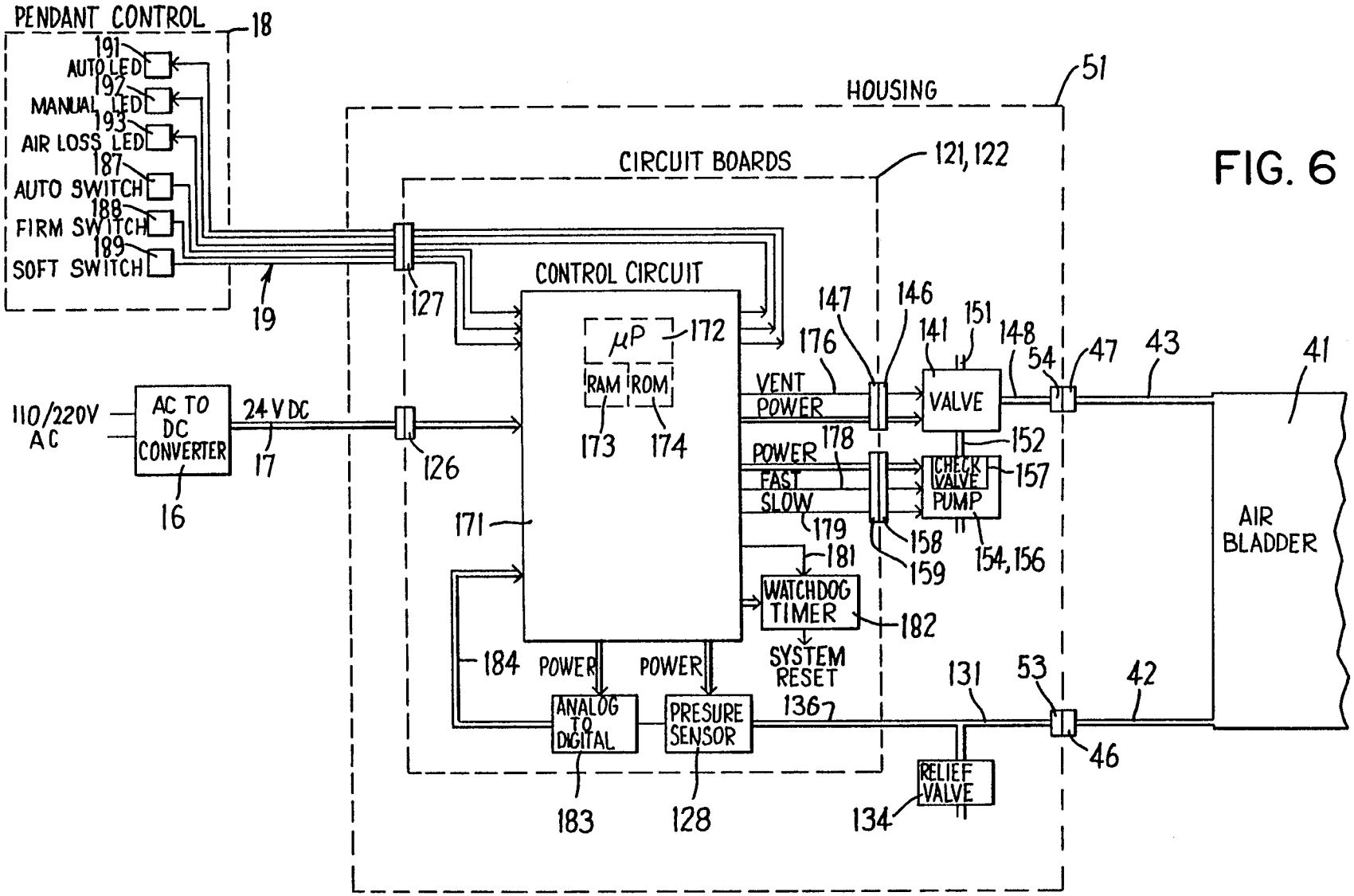
FIG. 6 is a block diagram of the components in the control unit of FIG. 5 and of other components to which they are coupled.

FIG. 6 is a block diagram of the air pressure control system, and components which have already been described above in association with FIGS. 1–5 are designated with the same reference numerals and are not described again in detail.

The circuit boards 121 and 122 have thereon a control circuit 171, which is implemented with a microprocessor 172 and associated support circuitry, including random access memory (RAM) 173 and read only memory (ROM) 174. The microprocessor 172 can be almost any conventional and commercially available microprocessor. In the preferred embodiment, it is a MC68HC11AOP available from Motorola, Inc. of Austin, Tex. The ROM 174 stores the program executed by the microprocessor 172, and also stores data which is constant and does not change during system operation. The RAM 173 stores data which is dynamically changed by the computer program during system operation.

The microprocessor 172 controls a VENT output 176, which is connected through the mating connector parts 146 and 147 to the control valve 141. When the VENT line 176 is actuated, the control valve 141 effects fluid communication between the air conduit 148 and exhaust opening 151, whereas when the VENT line 177 is deactuated (or the valve has no power) the control valve 141 effects fluid communication between the air conduit 148 and the output conduit 152 from the pump 154. In the latter case, and when the pump is not running (either because it is deactuated or because it has no power), the check valve 157 obstructs any air flow out of the conduit 148 through the valve and pump. This ensures that, if power is lost, the valve will not bleed pressure from the air bladder while it is supporting a patient.

The control circuit 171 also has a FAST output line 178 and a SLOW output line 179, which are each connected through mating connector parts 158 and 159 to the pump 154. When the FAST output 178 is actuated, the pump 154 operates at a relatively fast speed, whereas when the SLOW output 179 is actuated, the pump 154 operates at a slower speed that causes it to generate less noise and to output compressed air at a reduced rate.

It should be noted that the configuration of the pump motor 156, valve 141 and check valve 157 is such that the motor 156 and valve 141 never need to be energized simultaneously during normal system operation, which spreads out power consumption.

Also provided on the circuit boards 121 and 122 is a watchdog timer circuit 182, and the control circuit 171 has an output 181 which is connected to an input of the watchdog timer circuit 182. The watchdog timer circuit is itself conventional, and in the preferred embodiment is a retriggerable monostable multivibrator or "one-shot", which is periodically retriggered in a manner described later and thus should not expire during normal system operation. However, in the event an abnormal condition causes the watchdog timer 182 to expire, it outputs a system reset signal which resets the control circuitry.

The circuitry on circuit boards 121 and 122 also includes a conventional analog-to-digital converter 183. The analog output signal from the pressure sensor 128 is applied to an input of the analog-to-digital converter 183, and the digital outputs 184 from the converter are applied to inputs of the control circuit 171.

As previously mentioned, the hand-held pendant 18 has three push-button switches 187–189 which can be manually operated, and which are respectively labeled AUTO, FIRM and SOFT. Each is connected through the pendant cable 19 to the control circuit 171. The control circuit 171 has outputs which are connected through the pendant cable 19 to the three LEDs 191–193 on the pendant, which are respectively labelled AUTO, MANUAL and AIR LOSS. It should be noted that all controls are in one place, namely on the hand-held pendant.

In the preferred embodiment, all of the circuitry in the control unit and in the pendant uses less than a total of 15 watts of power at the 24 VDC input provided by the AC/DC converter 16 due in part to the fact that the motor 156 and valve 141 are never energized simultaneously. There are thus no high voltages in or large amounts of heat dissipated in the mattress, which is a safety feature.

Figure 7:
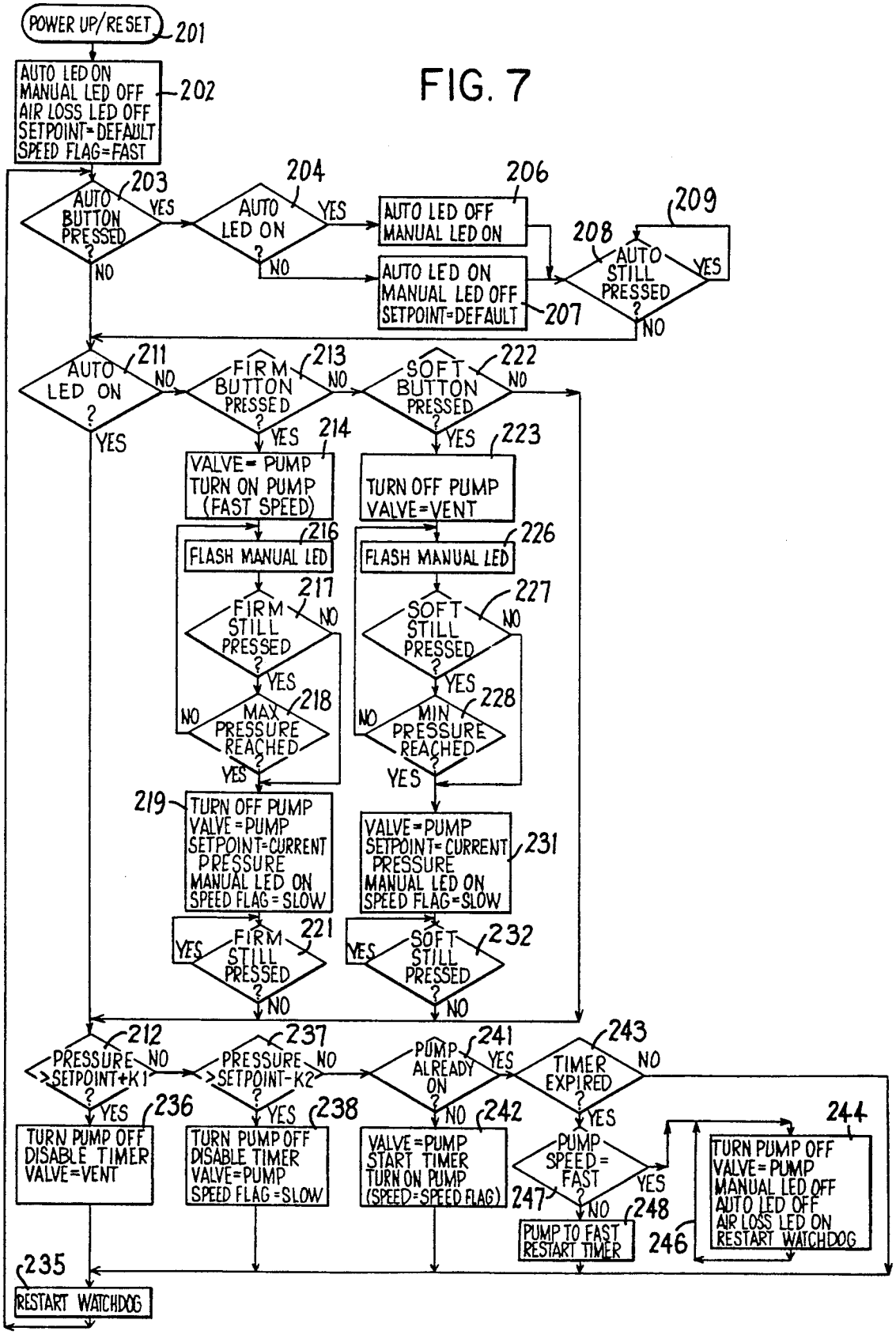
FIG. 7 is a flowchart of a computer program executed by a microprocessor which is a component of the control unit of FIGS. 5 and 6.

The computer program which is stored in the ROM 174 and which is executed by the microprocessor 172 will now be described in detail with reference to FIG. 7. After power is turned on, or following a system reset, execution begins at block 201, and proceeds to block 202. In block 202, the microprocessor 172 turns on the AUTO LED 191 (FIG. 6), and turns off the MANUAL and AIR LOSS LEDs 192 and 193. Then, the microprocessor initializes a pressure set point value maintained in the RAM 173 to a default pressure, which is a predetermined constant stored in the ROM 174 and, in the preferred embodiment, is 100 mm $H_2O$. Then, the microprocessor initializes a speed flag, which is also maintained in the RAM 173 and which indicates the speed at which the pump should be operated during operation in the AUTO mode. The speed flag is set to a condition specifying that the pump should be operated at its faster speed. This ensures that, during initial operation, the air bladder 41 will be relatively quickly brought into conformity with the prevailing pressure set point.

Control then proceeds to block 203, where the microprocessor checks to see if the AUTO push button 187 on the pendant is manually pressed. The AUTO push button functions as a toggle, and switches the system between an AUTO mode in which the air bladder 41 is maintained at the default pressure set point and a MANUAL mode in which the air bladder 41 is maintained at a set point manually entered by a user. If it is determined at block 203 that the user has pressed the AUTO button, then control proceeds to block 204, where the microprocessor checks to see if the AUTO LED is on. If it is, then the system has been operating in AUTO mode, and control proceeds to block 206 where the AUTO LED is turned off and the MANUAL LED is turned on in order to effect a switch to MANUAL mode.

On the other hand, if it is determined in block 204 that the AUTO LED is off, then the system has been operating in the MANUAL mode and control proceeds to block 207, where the AUTO LED is turned on and the MANUAL LED is turned off in order to effect a switch from MANUAL mode to AUTO mode. Block 207 also sets the pressure set point to the default value which is used in the AUTO mode, thereby overriding any user-selected set point which may have been manually entered during operation in the MANUAL mode. From blocks 206 and 207, control proceeds to block 208, where the microprocessor waits at 209 until the AUTO button is released. Then, control proceeds to block 211. Control also proceeds directly from block 203 to block 211 if it is determined at block 203 that the AUTO button is not pushed.

At block 211, the microprocessor checks to see if the AUTO LED is on. If it is, then the system is operating in the AUTO mode, in which case the FIRM and SOFT buttons are to be ignored, and control proceeds directly from block 211 to block 212 in order to skip the portion of the program which handles the FIRM and SOFT buttons. On the other hand, if it is found at block 211 that the system is presently operating in MANUAL mode, then control proceeds to block 213, where a check is made to see if the FIRM button has been pressed.

If it is found at block 213 that the FIRM button has been pressed, then control proceeds to block 214, where the microprocessor 172 VENT output 176 is deactuated in order to ensure that the control valve 141 is effecting fluid communication between the pump 154 and the conduit 148 to the mattress, and then actuates its FAST output 178 in order to cause the pump to run at its fast speed. The pump is always operated at its fast speed when the user presses the FIRM button, regardless of the setting of the speed flag, in order to ensure that the pressure in the air bladder 41 is increased as quickly as possible when the user is intentionally effecting a pressure increase, and because the operation of the pump is more audible during operation at the faster speed and thus provides audible feedback to the user that something is in fact happening within the mattress in response to depression of the FIRM button.

From block 214, control proceeds to block 216, where the MANUAL LED is flashed in order to provide visual feedback to the user that something is happening in response to depression of the FIRM button. At block 217, the microprocessor checks to see if the FIRM button is still pressed to indicate that the user wishes to further increase the pressure. If so, then at block 218 the actual air pressure in the air bladder 41 is read from the sensor 128 (through the A/D converter 183), and is compared to a predetermined maximum pressure. If the actual pressure is below the maximum, then the microprocessor remains in the loop containing blocks 216–218 while the pump continues to supply pressurized air to the air bladder 41.

When it is ultimately determined at block 217 that the FIRM button has been released, or at block 218 that the maximum pressure has been reached, control proceeds to block 219 in order to terminate the introduction of pressurized air into the air bladder. In particular, at block 219, the microprocessor deactuates the FAST output 178 in order to turn off the pump. Since the valve 141 is not actuated and is thus coupling conduit 148 to conduit 152 the check valve 157 in pump 154 obstructs air flow out of the bladder through the conduit 148. Typically, the user will release the FIRM push button when the air bladder 41 reaches the pressure which the user wants to maintain, and therefore in block 219 the microprocessor reads the output of the pressure sensor 128 in order to determine the current air pressure in the air bladder 41, and stores this value in the pressure set point. The blinking MANUAL LED is then restored to a continuously on state. Finally, the speed flag is set to select slow pump operation, because the pressure in the air bladder 41 is now by definition equal to the prevailing set point, and thus the slow pump speed will be used to maintain the pressure at that set point (except in the event the user again manually presses the FIRM button). Then, in block 221, the microprocessor checks to see if the FIRM button is still pressed. This is to ensure that, in the rare event where the maximum pressure is detected at block 218 and control proceeds to block 219 before the user releases the FIRM button, the system will nevertheless wait at block 221 until the user releases the FIRM button before proceeding to block 212.

If it was found at block 213 that the FIRM button was not currently pressed, then control would proceed to block 222, where the system checks to see if the SOFT button has been pressed by the user in order to indicate that the pressure in the air bladder 41 is to be decreased. If so, then control proceeds to block 223, where the microprocessor ensures that both the FAST and SLOW lines 178 and 179 are deactuated in order to be certain that the pump 154 is off, and then actuates the VENT output 176 in order to cause the valve 141 to couple the conduit 148 to the exhaust opening 151 so that air from the air bladder 41 bleeds to the atmosphere through conduit 148 and valve 141. Then, control proceeds to the loop containing blocks 226–228, which are functionally equivalent to previously-described blocks 216–218, except that block 228 checks for a minimum pressure rather than a maximum pressure.

Control ultimately proceeds to block 231, where the microprocessor deactuates the VENT output 176 in order to close the valve 141 and thus cause check valve 157 to prevent air flow out of the bladder through the conduit 148. The current pressure in the air bladder 41 is read from the sensor 128 and used to update the pressure set point, the MANUAL LED is set to be continuously on, and the speed flag is set to select slow pump operation. Control then proceeds to block 232, where the microprocessor verifies that the SOFT button has been released, for the same reasons already discussed above in association with block 221. Control then proceeds from block 232 to block 212. Also, if it was determined at block 222 that the SOFT button was not pressed, control would have proceeded at 233 directly from block 222 to block 212.

At block 212, the microprocessor reads the current pressure in the air bladder 41 from the sensor 128, and compares this pressure to a value which is the pressure set point plus a predetermined constant value K1. If the pressure has increased above the set point by more than the amount K1, then some air needs to be bled from the air bladder 41 in order to bring the pressure back down to the set point, and so at block 236 the microprocessor ensures that the pump is off by deactuating both the FAST and SLOW outputs 178 and 179, and disables a pump timer which is used to measure how long the pump has been running. In the preferred embodiment, the pump timer has a duration of ten minutes, is implemented in software, and is updated in a manner which is entirely conventional and therefore not shown and described in detail. It will be recognized that, if the particular microprocessor selected for use at 172 includes a conventional hardware timer, the hardware timer could be used to implement the pump timer. After the pump timer is disabled in block 236, the microprocessor 172 actuates the VENT output 176, so that the control valve 141 couples the conduit 158 to the exhaust opening 151 in order to bleed air from the air bladder 41. Control then proceeds to block 235 with the valve 141 bleeding air from the bladder.

If it was determined at block 212 that the actual pressure has not exceeded the pressure set point by a constant value K1, that at block 237 a check is made to see if the actual pressure has decreased below the set point by a constant value K2. The constant K2 could be the same as constant K1, but there is no requirement that it be the same. If it is determined at block 237 that the pressure has not dropped below the set point by an amount of at least K2, then the actual pressure is within a range which surrounds the set point and which represents a pressure differential of (K1+K2). If the actual pressure is within this range, then the actual pressure is treated as being effectively at the set point, and no pressure adjustment is made. Therefore, control proceeds to block 238, where the microprocessor deactuates both the FAST and SLOW outputs 178 and 179 in order to be certain that the pump 154 is off, disables the pump timer, and deactuates the VENT output 176 in order to close the valve 141 so that air flow out of the bladder through the conduit 148 is obstructed. Then, the speed flag is set to select slow pump operation, because the actual pressure is substantially at the set point and slow pump operation is to be used to maintain it at the set point (except in the case where the user manually presses the FIRM button or SOFT button). Control then proceeds to block 235.

On the other hand, if it is determined at block 237 that the actual pressure has dropped below the set point by more than the value K2, then air needs to be supplied to the air bladder in order to bring the pressure back up to the set point, and control proceeds to block 241, where the microprocessor checks to see if the pump is already running, or in other words whether the pump was started during a previous pass through this portion of the program but has not yet brought the pressure into the acceptable pressure range surrounding the set point. Assuming the pump has not yet been started, then at block 242 the microprocessor ensures that the VENT output 176 is deactuated in order to be certain that the valve 141 couples the pump output 152 to the conduit 148, then starts the software pump timer which measures the length of time the pump has been running, and then actuates one of the FAST and SLOW lines 178 and 179 in dependence on the current state of the speed flag in order to cause the pump to begin running. Control then proceeds to block 235, while the pump continues to run.

If it was found at block 241 that the pump is already running, then the pump timer has been started and control proceeds to block 243, where the microprocessor checks to see if the pump timer has expired. If it has not, then control proceeds directly to block 235 while allowing the pump to continue running in order to bring the actual pressure up to the set point.

In the normal case, program execution will proceed to block 235 from one of the blocks 236, 238, 242 and 243. In block 235, the microprocessor produces an output on line 181 to restart the watchdog timer. Then, control returns to block 203, which is the start of the main loop of the computer program.

However, if it is determined at block 243 that the timer has expired, this means that the pump has been running longer than should be necessary in order to reach equilibrium, and that there is probably an air leak somewhere in the system which is counteracting the efforts of the pump. Therefore, at block 247, the microprocessor checks to see if the pump is running at its fast speed and, if not, proceeds to block 248 where it shifts the pump to its fast speed and restarts the timer. Otherwise, if it is found at block 247 that the timer expired with the pump already running at its fast speed, control proceeds to block 244, where the system shuts down. In particular, the microprocessor deactuates both of the FAST and SLOW outputs 178 and 179 in order to turn off the pump, and deactuates the VENT output 176 in order to close the valve 141 so that the check valve 157 obstructs all air flow out of the conduit 148. Then, the microprocessor turns off both the MANUAL LED and AUTO LED, and turns on the AIR LOSS LED in order to indicate that there is probably a leak in the system which is causing a loss of air. Then, the microprocessor produces an output on line 181 in order to restart the watchdog timer 182 and thus prevent the watchdog timer from generating a system reset which would restart program execution at block 201. Then, at 246, the microprocessor remains in an endless loop repeating block 244. The only way to exit this loop is through human intervention, in particular when someone turns off power to the system in order to check for a leak. When power is thereafter restored, program execution will commence at block 201.

OPERATION

When the AC/DC converter 16 is first plugged in and supplies power to the system, the microprocessor 172 is forcibly initialized into the AUTO mode of operation, and the pressure set point is forcibly set to the predetermined default set point which is always used in the AUTO mode. This occurs at block 202 in FIG. 7. Then, since no buttons on the pendant are typically pushed at this point in time, control will normally proceed through blocks 203 and 211 to blocks 212 and 237, where it may be found that the actual pressure in the bladder is below the acceptable pressure range around the default set point. If so, then at block 242 the valve 141 will be set to select the pump, the pump timer will be started, and the pump will be turned on at the speed specified by the speed flag. Since the system has just been turned on, the speed flag will have been set by block 202 to select fast operation, in order to ensure that the pressure in the air bladder 41 is brought into compliance with the default set point as quickly as possible. While the pump continues to run, control will proceed to block 235 in order to restart the watchdog timer, and then will return to the start of the main loop at block 203. Assuming the user does not press any buttons on the pendant, the microprocessor will make a number of passes through the loop containing blocks 203, 211, 212, 237, 241, 243 and 235. Eventually, it will be determined at block 237 that the actual pressure in the air bladder has entered the acceptable range around the set point, and therefore at block 238 the pump will be turned off, the pump timer will be disabled, and the speed flag will be set to select slow operation. Further pump operation to maintain the set point will thus be carried out at the slower pump speed, at which the pump is almost inaudible to a user and thus will not disturb a user who happens to be sleeping on the mattress.

As the user thereafter shifts position on the mattress, the actual pressure in the air bladder 41 may increase or decrease to a point outside the range around the set point. If the pressure is too high, then at blocks 212 and 236 the valve 141 is opened to the atmosphere in order to reduce the pressure in the air bladder 41, and is subsequently closed at blocks 237 and 238 when the pressure again reaches the acceptable range. Alternatively, if the user shifts so that the pressure drops below the acceptable range, the pump is started again at the slow speed at blocks 241 and 242, and is subsequently stopped at blocks 237 and 238 when the pressure has again reached the acceptable range.

If the user decides at some point to change the pressure set point, the user presses the AUTO button, causing control to proceed from block 203 through block 204 to block 206, where the system is shifted from AUTO mode to MANUAL mode, and then back to the main loop through block 208. At this point, the pressure set point is still the default set point, and blocks 212, 237 and 241 will still continue to control the air pressure in the air bladder 41 based on the default set point.

Assuming that at some point the user presses the FIRM button in order to increase the set point, control will proceed through block 213 to block 214, where air will be supplied from the pump to the air bladder at the fast pump speed and the MANUAL LED will be flashed at 216. When the instantaneous pressure in the air bladder 41 is satisfactory to the user, the user releases the FIRM button, and control proceeds from block 217 to block 219, where the pump 154 is turned off, and the set point is set to the current pressure in the air bladder 41 as measured by the pressure sensor 128. Thereafter, blocks 212, 237 and 241 will make decisions which operate the pump and/or valve so as to maintain the actual pressure in the air bladder 41 at the new set point manually specified by the user.

Alternatively, if the user presses the SOFT button in MANUAL mode, then control proceeds through block 222 to block 223, where the valve 141 bleeds air from the air bladder 41 to the atmosphere in order to reduce the air pressure, while flashing the MANUAL LED at 226. When the instantaneous air pressure in the air bladder 41 is satisfactory to the user and the user releases the SOFT button, control proceeds from block 227 to block 231, where the valve 141 again couples conduits 148 and 152 and the set point is set to the actual pressure in the air bladder 41 as measured by the pressure sensor 128. Blocks 212, 237 and 241 thereafter control the pump and/or valve to the extent necessary to maintain the actual pressure in the air bladder 41 at the new set point manually specified by the user.

In the event the user subsequently again presses the AUTO button in order to switch from the MANUAL mode back to the AUTO mode, control proceeds through blocks 203 and 204 to block 207, where the AUTO LED is turned on, the MANUAL LED is turned off, and the pressure set point is restored to the default value used in AUTO mode. Blocks 212, 237 and 241 would thereafter make decisions causing the pump 154 and/or valve 141 to be controlled in a manner bringing the actual pressure in air bladder 41 into conformity with the default set point, and to thereafter maintain it in conformity with the default set point.

It will be noted that the materials and structure of the disclosed mattress unit 10 allow it to flex somewhat, so that it can be used on a bed having a movable fowler portion without damage to the mattress unit.

Although a single preferred embodiment of the invention has been disclosed in detail for illustrative purposes, it will be recognized that there are variations or modifications of the preferred embodiment, including the rearrangement of parts, which lie within the scope of the present invention.

What is claimed is:

1. An apparatus comprising: a mattress unit having an inflatable bladder therein, and having selectively actuable means therein responsive to a gas pressure in said bladder for selectively supplying pressurized gas to and selectively removing gas from said inflatable bladder so as to automatically maintain said gas pressure in said bladder substantially at a specified pressure value, wherein said selectively actuable means is disposed in a foot support portion of said mattress unit, and wherein said bladder is disposed in an upper body support portion of said mattress unit.

2. An apparatus according to claim 1, wherein said selectively actuable means includes pressure sensor means for detecting a gas pressure within said bladder.

3. An apparatus comprising: a mattress unit having an inflatable bladder therein and having selectively actuable means for selectively supplying pressurized gas to and removing gas from said inflatable bladder; wherein said selectively actuable means is provided within said mattress unit; and wherein said mattress unit contains a foam material, said inflatable bladder and said selectively actuable means being embedded in said foam material.

4. An apparatus according to claim 2, wherein said foam material includes a bottom sheet of foam, a top sheet of foam, and intermediate foam components which are disposed between said top and bottom sheets and which define a first opening corresponding in size and shape to said inflatable bladder and a second opening corresponding in size and shape to a housing containing said selectively actuable means, said inflatable bladder and said housing being respectively disposed in said first and second openings.

5. An apparatus according to claim 3, wherein portions of said foam material surrounding said periphery of said inflatable bladder have a horizontal thickness of at least six inches, and portions of said foam material extending over the top of said inflatable bladder have a vertical thickness of at least two inches.

6. An apparatus comprising: a mattress unit having an inflatable bladder therein and having selectively actuable means for selectively supplying pressurized gas to and removing gas from said inflatable bladder; wherein said selectively actuable means is provided within said mattress unit, includes selectively and electrically actuable first means for supplying pressurized gas to said inflatable bladder, includes selectively and electrically actuable second means for removing gas from said inflatable bladder, and includes control circuit means electrically coupled to said first means and said second means for electrically effecting said selective actuation of each of said first means and said second means; and including an AC to DC converter which is external to and physically separate from said mattress, and which is coupled by a cable to said control circuit means disposed within said mattress for supplying power to said control circuit means through said cable.

7. An apparatus according to claim 6, wherein said control circuit means includes means defining a pressure setpoint, and means for effecting said selective actuation of said first and second means so as to maintain the pressure in said bladder approximately at said pressure setpoint.

8. An apparatus according to claim 7, including a manual control unit disposed externally to said mattress unit, and means for providing communication between said manual control unit and said control circuit means to facilitate variation of said pressure setpoint in response to manual operation of said manual control unit.

9. An apparatus according to claim 6, wherein said first means includes selectively actuable pump means for supplying pressurized gas to said inflatable bladder and said second means includes selectively actuable valve means for selectively removing gas from said inflatable bladder.

10. An apparatus according to claim 6, including a manual control unit which is disposed externally to said mattress unit, and means for facilitating communication between said manual control unit and said control circuit means disposed within said mattress unit to facilitate variation, in response to manual operation of said manual control unit, of a control function carried out by said control circuit means.

11. An apparatus according to claim 10, wherein said manual control unit is a hand-held unit which is physically separate from said mattress unit, which has thereon at least one manually actuable push button and which has means for providing visually perceptible indication under control of said control unit means.

12. An apparatus according to claim 10, wherein said manual control unit is a hand-held unit physically separate from said mattress unit, and said means for facilitating communication includes a cable electrically coupling said manual control unit to said control circuit means.

13. An apparatus comprising: a mattress unit, an inflatable bladder disposed within said mattress unit, manually actuable means for selectively varying a first pressure set point and for selecting one of first and second operational modes, and control means for controlling a gas pressure in said bladder, said control means including means responsive to selection of said second operational mode for automatically selectively supplying pressurized gas to and removing pressurized gas from said inflatable bladder so as to maintain the gas pressure in said bladder substantially at a second pressure set point, and means responsive to selection of said first operational mode for automatically selectively supplying pressurized gas to and removing pressurized gas from said inflatable bladder so as to maintain the gas pressure in said bladder substantially at said first pressure set point.

14. An apparatus according to claim 13, wherein said pressure set point is a predetermined constant.

15. An apparatus according to claim 13, wherein said control means includes means for effecting said supplying of pressurized gas to said inflatable bladder at a selected one of first and second rates, said first rate being greater than said second rate, said control means being responsive to changing of said first pressure set point to a value greater than the current pressure in said inflatable bladder for supplying said pressurized gas to said inflatable bladder at said first rate until the pressure in said bladder reaches said first pressure set point, and thereafter effecting said selective supplying of pressurized gas to said inflatable bladder at said second rate.

16. An apparatus according to claim 15, wherein during said second operational mode said control means effects said selective supplying of pressurized gas to said inflatable bladder at said second rate.

17. An apparatus comprising: a mattress unit; an inflatable bladder disposed within said mattress unit; and control means disposed within said mattress unit for controlling a gas pressure within said inflatable bladder, said control means including selectively actuable supply means for supplying pressurized gas to said bladder at a selected one of first and second rates, said first rate being substantially greater than said second rate.

18. An apparatus according to claim 17, wherein said second rate is a predetermined rate sufficiently low so that a person sleeping on said mattress unit is substantially undisturbed by audible sound produced by said control means within said mattress unit, and wherein said first rate is a predetermined rate at which said control means produces sound which is clearly audible to a person on said mattress unit to indicate that the gas pressure in said bladder is being increased.

19. An apparatus according to claim 18, including a manually operable control unit, said control means having means for supplying gas to said bladder at said first predetermined rate in response to manual operation of said control unit.

20. An apparatus comprising: a mattress unit; an inflatable bladder disposed within said mattress unit; and control means for controlling a gas pressure within said inflatable bladder, said control means including selectively actuable supply means for supplying pressurized gas to said bladder at a selected one of first and second rates, said first rate being greater than said second rate, said control means further including means for supplying gas to said bladder at said second rate when the gas pressure in said bladder is below a pressure value, and means responsive to the gas pressure in said bladder being below said pressure value after gas has been supplied to said bladder at said second rate for a predetermined time period for thereafter supplying gas to said bladder at said first rate.

21. An apparatus according to claim 20, wherein said control means includes means responsive to the gas pressure in said bladder being below said pressure value after gas has been supplied to said bladder at said first rate for a predetermined time period for terminating the supply of gas to said bladder and for generating an operator perceptible indication that a problem has been detected.

22. An apparatus comprising: a mattress unit; an inflatable bladder disposed within said mattress unit; and control means for controlling a gas pressure within said inflatable bladder, said control means including selectively actuable supply means for supplying pressurized gas to said bladder at a selected one of first and second rates, said first rate being greater than said second rate; wherein said control means includes an electrical control circuit and is responsive to turning on of power to said control circuit for supplying gas to said bladder at said first rate until the pressure in said bladder reaches a pressure value, and thereafter selectively supplying gas to said bladder at said second rate when necessary to maintain the pressure in said bladder at a desired pressure.

23. An apparatus comprising: a mattress unit; an inflatable bladder disposed within said mattress unit; control means for controlling a gas pressure within said inflatable bladder, said control means including selectively actuable supply means for supplying pressurized gas to said bladder at a selected one of first and second rates, said first rate being greater than said second rate; and manually operable means for manually specifying a desired pressure within said inflatable bladder, said control means being responsive to manual actuation of said manually operable means in a manner specifying a desired pressure greater than a current actual pressure within said inflatable bladder for effecting said supply of pressurized gas to said bladder at said first rate in order to reach said desired pressure, and thereafter selectively supplying gas to said inflatable bladder at said second rate when necessary to maintain the pressure in said bladder at said desired pressure.

24. An apparatus according to claim 23, wherein said control means is operable in a selected one of first and second modes, said control means being responsive to said manually operable means in said first mode and ignoring said manually operable means in said second mode, wherein in said second mode said control means effects said selective supplying of gas to said inflatable bladder at said second rate to maintain the gas pressure in said bladder substantially at a further pressure.

25. An apparatus according to claim 24, including means responsive to initial actuation of said control means for causing said control means to initially operate in said second operational mode and to selectively supply pressurized gas to said bladder at said first rate until said further pressure is reached for the first time.

26. An apparatus according to claim 25, wherein said manually operable means includes means for manually effecting said selection of one of said first and second operational modes for said control means.

27. An apparatus comprising: a mattress unit; an inflatable bladder disposed within said mattress unit; control means disposed within said mattress unit for selectively supplying pressurized gas to and removing gas from said inflatable bladder so at to maintain the gas pressure in said bladder at a specified pressure; and a hand-held control unit separate from and external to said mattress unit and means facilitating communication between said control unit and said control means to effect manual variation of said specified pressure, wherein said hand-held control unit has a first push button which causes said control means to switch between first and second operational modes in which said control means respectively uses as said specified pressure a predetermined pressure value and a manually-entered pressure value, includes a second push button for manually increasing said manually-entered pressure value, and includes a third push button for manually decreasing said manually-entered pressure value; wherein said hand-held control unit has first and second visual indicators which are respectively actuated by said control means when said control means is respectively operating in said first and second operational modes; wherein said control means includes means for detecting a leakage of air from said inflatable bladder; and wherein said hand-held control unit has a further visual indicator which is actuated by said control means in response to a detection of air leakage from said inflatable bladder.

28. An apparatus comprising: a mattress unit having therein an inflatable bladder, and having therein a foam material which extends around the entire periphery of said inflatable bladder and covers the entire top of said inflatable bladder, wherein portions of said foam material surrounding said periphery of said inflatable bladder have a horizontal thickness of at least six inches, and portions of said foam material extending over the top of said inflatable bladder have a vertical thickness of at least two inches, wherein said inflatable bladder has a foam material therein, and wherein said foam material in said bladder has a plurality of openings provided at spaced locations therein.

29. An apparatus comprising: a mattress unit having therein an inflatable bladder, and having therein a foam material which extends around the entire periphery of said inflatable bladder and covers the entire top of said inflatable bladder, wherein portions of said foam material surrounding said periphery of said inflatable bladder have a horizontal thickness of at least six inches, and portions of said foam material extending over the top of said inflatable bladder have a vertical thickness of at least two inches, wherein said foam material includes a bottom sheet of foam material extending the full length and width of said mattress, a top sheet of foam material spaced above said bottom sheet and extending the full length and width of said mattress, and intermediate elements of foam material disposed between said top and bottom sheets and defining an opening corresponding in size and shape to said inflatable bladder, said inflatable bladder being disposed between said top and bottom sheets within said opening, and wherein said intermediate elements include first and second side elements disposed on opposite sides of said inflatable bladder and each extending from a head end of said mattress unit approximately three-quarters of the distance to a foot end of said mattress, a head element extending between said side elements at said head end of said mattress, and at least one foot element extending between the sides of said mattress and from said foot end to the adjacent ends of said side elements, said side elements and said further element each having inner surfaces which face peripheral edges of said inflatable bladder and which are concave.

30. An apparatus according to claim 29, wherein said mattress unit includes a fabric cover having said inflatable bladder and all of said foam elements therein, said foam elements being free of physical interconnections to other said foam elements, said bladder and said cover.

31. An apparatus comprising: a mattress unit; an inflatable bladder disposed within said mattress unit; and selectively actuable control means disposed within said mattress unit for selectively supplying pressurized gas to and removing gas from said bladder; wherein said inflatable bladder includes a gas impermeable cover having therein a foam material, said foam material in said bladder having a plurality of openings provided at spaced locations therein.

32. An apparatus according to claim 31, wherein a first pair of adjacent said openings are spaced by a distance which is different from the distance between a second pair of adjacent said openings.

33. An apparatus according to claim 32, wherein each said opening is a cylindrical hole extending completely through said foam material in a horizontal direction transversely of said mattress unit, said holes being provided at locations which are spaced from each other in a direction lengthwise of said mattress unit, each end of said bladder having a group of holes which are uniformly spaced from each other by substantially a first distance, and a central portion of said bladder having a further group of said holes which are spaced by a second distance greater than said first distance.

34. An apparatus according to claim 31, wherein two of said holes are of different size.

35. An apparatus according to claim 27, including a foam material which is disposed within said mattress unit and which extends around the entire periphery of said inflatable bladder and covers the entire top of said inflatable bladder, wherein portions of said foam material surrounding said periphery of said inflatable bladder have a horizontal thickness of at least six inches, and portions of said foam material extending over the top of said inflatable bladder have a vertical thickness of at least two inches.

36. An apparatus according to claim 35, wherein said foam material includes a bottom sheet of foam material extending the full length and width of said mattress, a top sheet of foam material spaced above said bottom sheet and extending the full length and width of said mattress, and intermediate elements of foam material disposed between said top and bottom sheets and defining an opening corresponding in size and shape to said inflatable bladder, said inflatable bladder being disposed between said top and bottom sheets within said opening.

37. An apparatus, comprising: a mattress unit having therein an inflatable bladder and having therein selectively and electrically actuable pressure control means for changing a gas pressure within said bladder, and a control unit physically separate from said mattress unit and electrically coupled by a cable to said pressure control means in said mattress unit, wherein said cable enters said mattress unit through an opening which is in a bottom surface of said mattress unit and which is spaced a substantial distance inwardly from each edge of said bottom surface of said mattress unit.

* * * * *

UNITED STATES PATENT AND TRADEMARK OFFICE

CERTIFICATE OF CORRECTION

PATENT NO. : 5 325 551

DATED : July 5, 1994

INVENTOR(S) : James G. TAPPEL et al

It is certified that error appears in the above-identified patent and that said Letters Patent is hereby corrected as shown below:

Column 16, line 59; before "presssure" insert ---second---.

Column 16, line 34; change "unit" to ---circuit---.

Signed and Sealed this

Twenty-seventh Day of September, 1994

*Attest:*

*Attesting Officer*

Bruce Lehman

BRUCE LEHMAN

*Commissioner of Patents and Trademarks*